US005211857A

United States Patent [19]

Brinker

[11] Patent Number: 5,211,857

[45] Date of Patent: May 18, 1993

[54] GATE SAFETY ARRANGEMENT

[75] Inventor: David M. Brinker, Watervliet, Mich.

[73] Assignee: Leco Corporation, Augusta, Ga.

[21] Appl. No.: 606,163

[22] Filed: Oct. 31, 1990

[51] Int. Cl.[5] ..... B22D 41/24
[52] U.S. Cl. ..... 222/600; 222/591
[58] Field of Search ..... 222/594, 600, 590, 591, 222/597

[56] References Cited

U.S. PATENT DOCUMENTS

| | | | |
|---|---|---|---|
| 4,415,103 | 11/1983 | Shapland et al. | 222/600 |
| 4,603,842 | 8/1986 | King | 222/590 |
| 5,011,050 | 4/1991 | Verel | 222/600 |

*Primary Examiner*—Scott Kastler
*Attorney, Agent, or Firm*—B. J. Powell

[57] ABSTRACT

A method and apparatus for loading a gate into a valve mechanism with a gate safety arrangement for physically preventing the gate from being loaded in the valve mechanism unless the gate has a prescribed orientation with respect to the loading path into the valve mechanism.

22 Claims, 13 Drawing Sheets

RIGHT ORIENTATION

WRONG ORIENTATION

RIGHT ORIENTATION

WRONG ORIENTATION

GATE SAFETY ARRANGEMENT

BACKGROUND OF THE INVENTION

This invention relates generally to slide gate valve mechanisms for controlling the flow of molten metal and more particularly to a gate safety arrangement which permits loading a gate in a valve mechanism for pouring molten metal only when the gate has a predetermined orientation.

Valve mechanisms for controlling the flow of molten metal from a holding vessel are commonly available. One type of such valve mechanism uses slide gates which are first moved into a loaded position in the mechanism along a loading path and then moved into operative position in the mechanism along a firing path by a firing cylinder. These are commonly known as sequential type valve mechanisms.

One configuration of these sequential type valve mechanisms both loads and fires the slide gates along a common path. Examples of this valve mechanism configuration are illustrated in:

| U.S. Pat. No. | Inventor | Issue Date |
|---|---|---|
| Re. 27,237 | J. T. Shapland | November 23, 1971 |
| 3,436,023 | A. Thalmann | April 1, 1969 |
| 3,454,201 | P. C. McShane | April 1, 1969 |
| 3,866,806 | E. P. Shapland | February 1975 |

Another configuration of such sequential type valve mechanisms loads the slide gates along a loading path and then fires the slide gate into position along the firing path perpendicular to the loading path. Examples of this valve mechanism configuration are disclosed in:

| U.S. Pat. No. | Inventor | Issue Date |
|---|---|---|
| 4,415,103 | E. P. Shapland, et al. | November 15, 1983 |
| 4,545,512 | E. P. Shapland, et al. | October 8, 1985 |

Typically, this latter configuration uses a running gate with the hole, through which the molten metal flows, offset from the gate center to facilitate throttling molten metal flow through the valve mechanism by moving the running gate laterally of the firing axis. The metal flow hole through the shroud plate in this configuration is typically centered on the metal flow hole through the top plate during operation. Both the running gate and shroud gate are typically rectilinear with a slightly greater length in one direction than in the other. Thus, these gates can be reversed as they are loaded into the valve mechanism.

The fact that the running gate can be reversed has posed problems over the years in that inadvertently reversing the running gate has immediate and disastrous results. This is because the valve mechanism is typically set to a closed position during gate change and reversing the running gate installs the new gate in an almost fully open position. Further, a reversed gate causes the valve mechanism to operate backwards. That is, the normal fully open position is the full closed position and the normal fully closed position is the fully open position when the running gate is reversed. In addition, a reversed running gate prevents making any gas connections normally made directly to the running gate so that the molten metal being poured is typically downgraded to a less desirable grade of steel.

A reversed shroud gate may cause the outlets on the tubular shroud to be located out of proper alignment with the continuous casting mold and thus cause a breakout of molten metal. This too has immediate and disastrous results. Further, a reversed shroud gate may prevent making those gas connections normally made directly to the shroud gate or tubular shroud to cause downgrading the molten metal being poured.

SUMMARY OF THE INVENTION

These and other problems and disadvantages associated with the prior art are overcome by the invention disclosed herein by providing a means and method for assuring the proper orientation of the running gate and shroud gate in a sequential type valve mechanism or any other type of valve mechanism loaded similarly. The gates are physically prevented from being loaded into the valve mechanism to the loaded position for firing unless the gate is correctly oriented.

The method of the invention comprises the steps of locating the gate on loading rails with the gate loading axis in registration with the loading path; and, physically preventing the gate from entering the valve mechanism or from reaching the loaded position for firing unless the gate has a prescribed orientation with respect to the loading path.

The apparatus of th invention includes a gate safety arrangement operatively associated with the gate and valve mechanism to permit loading the gate only when it has a prescribed orientation. One embodiment of the gate safety arrangement includes an asymmetrical cross-sectional shape for the gate and a pre-position guide defining a gauging opening therethrough complementary to the gate. This requires a single gate orientation to pass through the gauging opening as the gate is loaded. The asymmetrical cross-sectional shape for the gate is typically provided by a locating recess extending along the length of one of the sides of the gate. The pre-positioning guide has a locating projection that fits into the recess. The gate will pass into the valve mechanism only when the projection is in registration with the recess.

Alternatively, the gate safety arrangement is a cutout formed in the gate which causes the gate to fall out of position in the valve mechanism unless the gate has the correct orientation for loading into the mechanism. In most of the valve mechanisms, the cutout is located on the leading corner of the gate nearest the firing cylinder. Where there is a possibility that the gate may be loaded from different sides of the valve mechanism, both leading corners have a cutout.

These and other features and advantages of the invention will become more apparent upon consideration of the following detailed description and accompanying drawings wherein like characters of reference designate corresponding parts throughout the several views and in which:

These figures and the following detailed description disclose specific embodiments of the invention, however, it is to be understood that the inventive concept is not limited thereto since it may be embodied in other forms.

DETAILED DESCRIPTION OF ILLUSTRATIVE EMBODIMENTS

The gate safety arrangement of the invention is designed for use with either or both the running gate and the shroud gate in a conventional sequential type slide gate valve mechanism SGVM used to control the flow of molten metal from vessels. While such valve mechanisms SGVM may be used on either tundishes or ladles, they are most typically used on tundishes and the arrangement of the invention is illustrated mounted on a tundish TUN.

Figure 6:
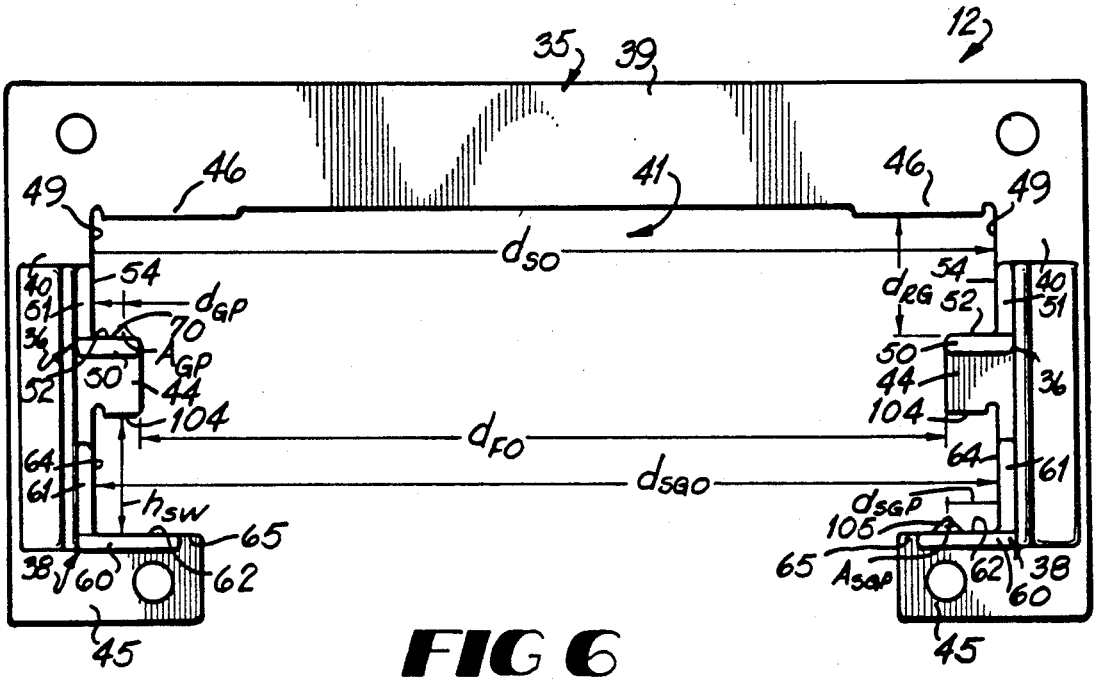
FIG. 6 is an enlarged end view of the pre-positioning guide assembly of the invention.
Figure 7:
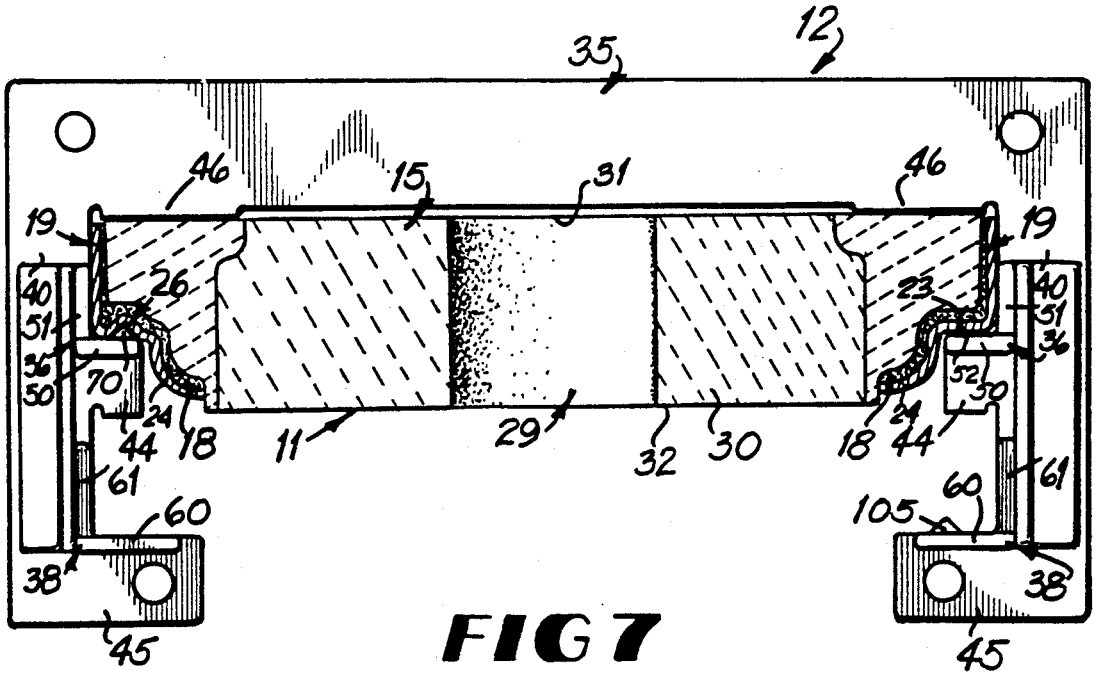
FIG. 7 is a view similar to FIG. 5 with the gate on the guide assembly of FIG. 6.
Figure 8:
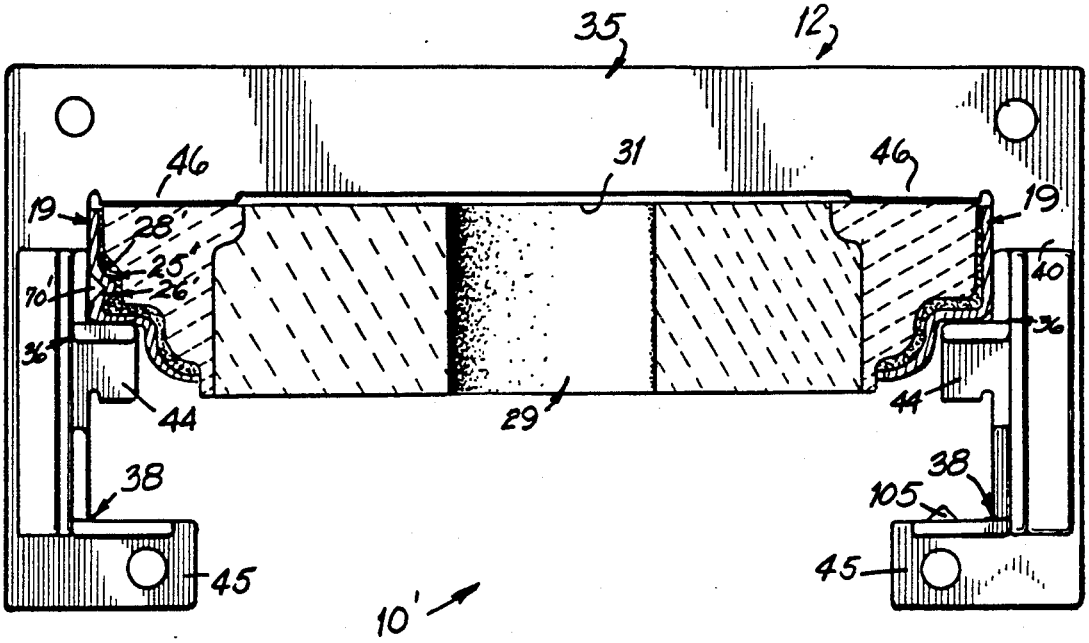
FIG. 8 is a view similar to FIG. 7 showing an alternate embodiment of the running gate safety arrangement.
Figure 11:
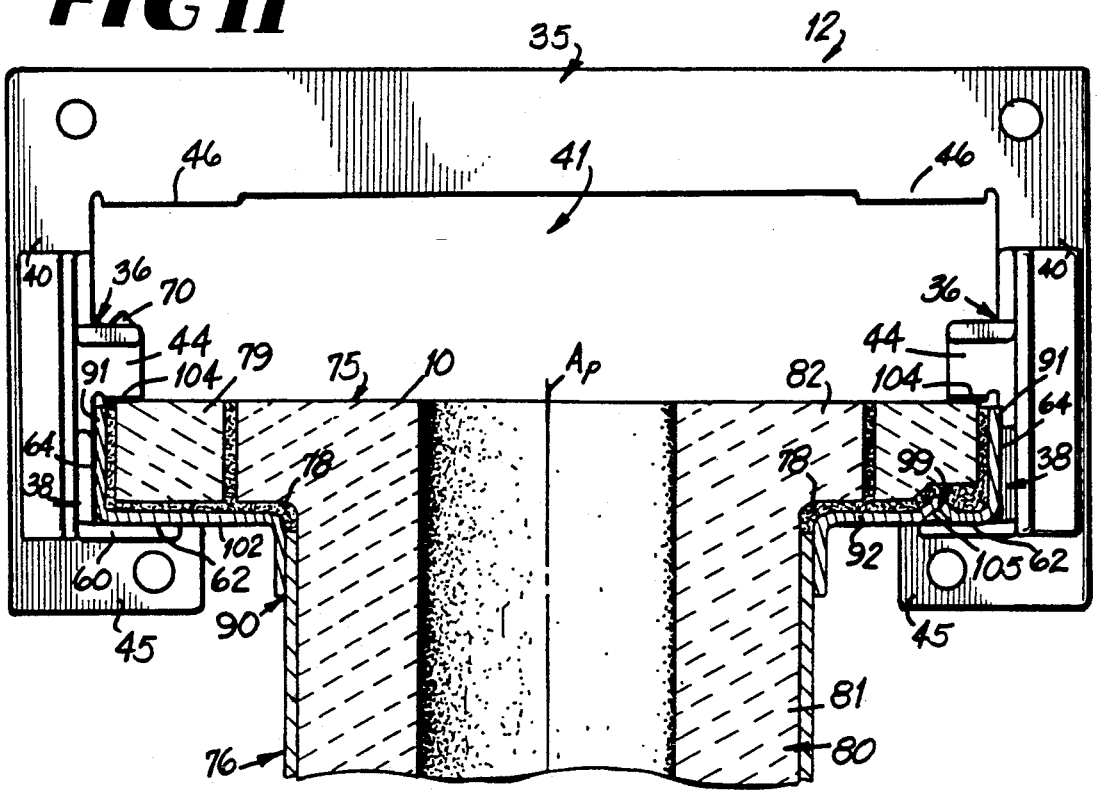
FIG. 11 is a view similar to FIG. 10 with the shroud gate on the guide assembly of FIG. 6.
Figure 9:
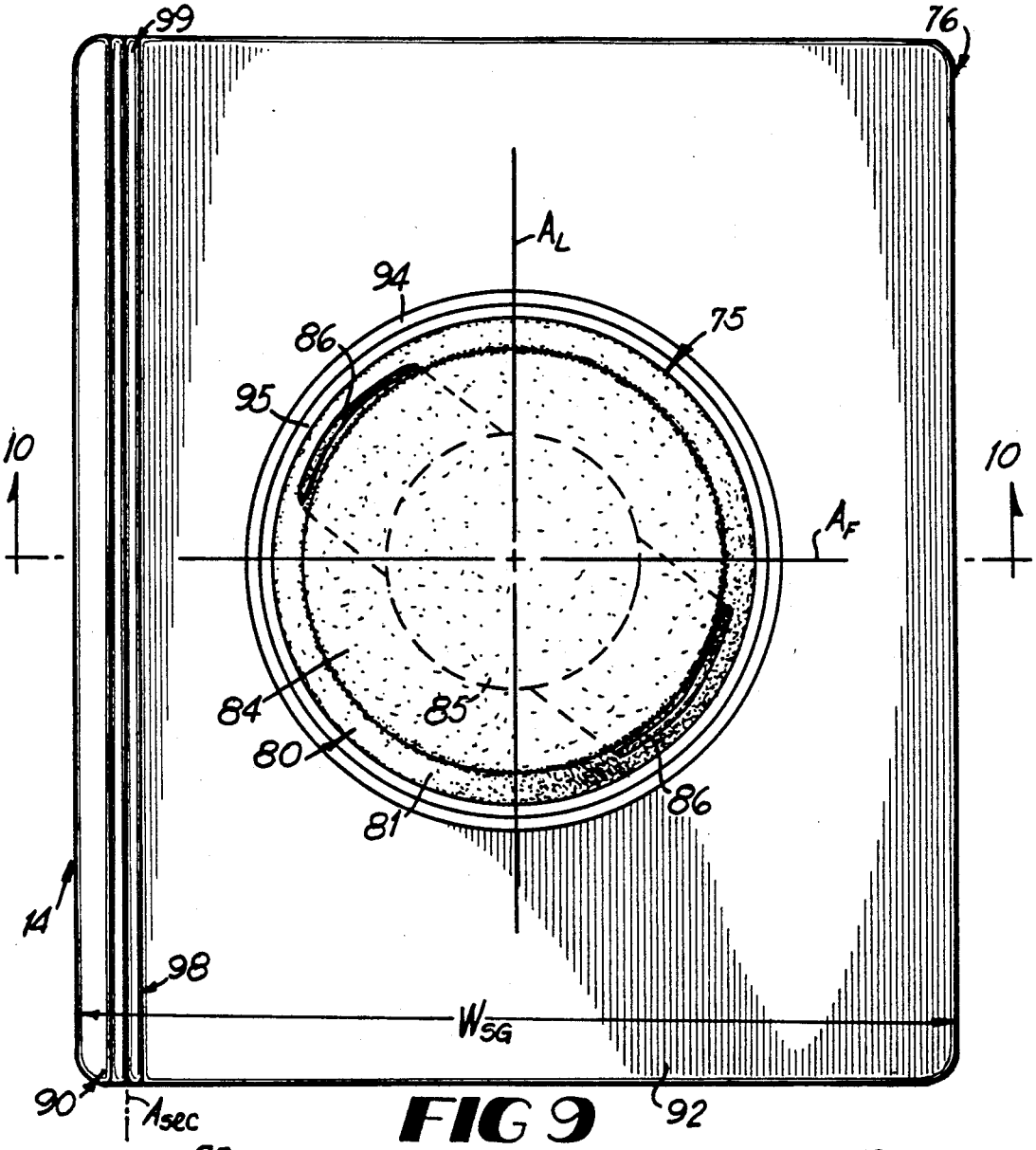
FIG. 9 is an enlarged bottom view of the shroud gate incorporating the invention.
Figure 10:
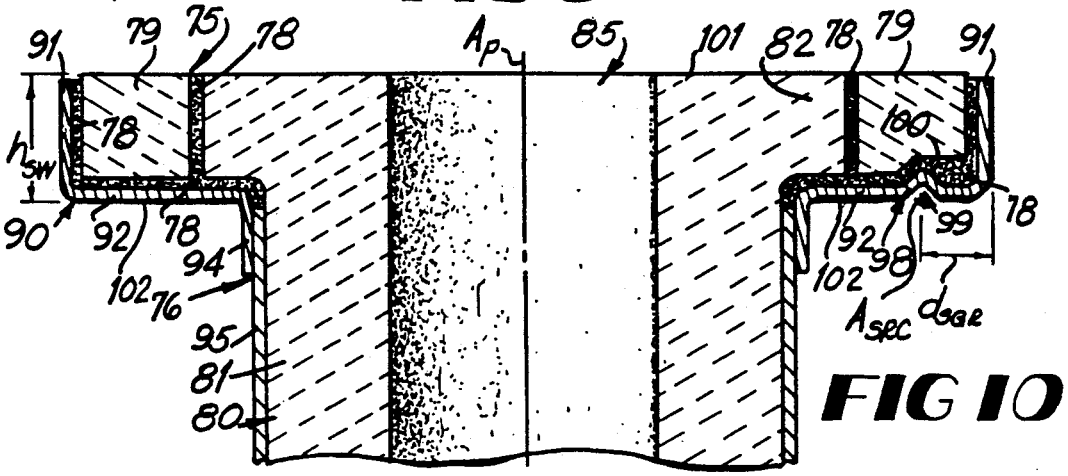
FIG. 10 is an enlarged cross-sectional view of the shroud gate taken along line 10—10 in FIG. 9.
Figure 12:
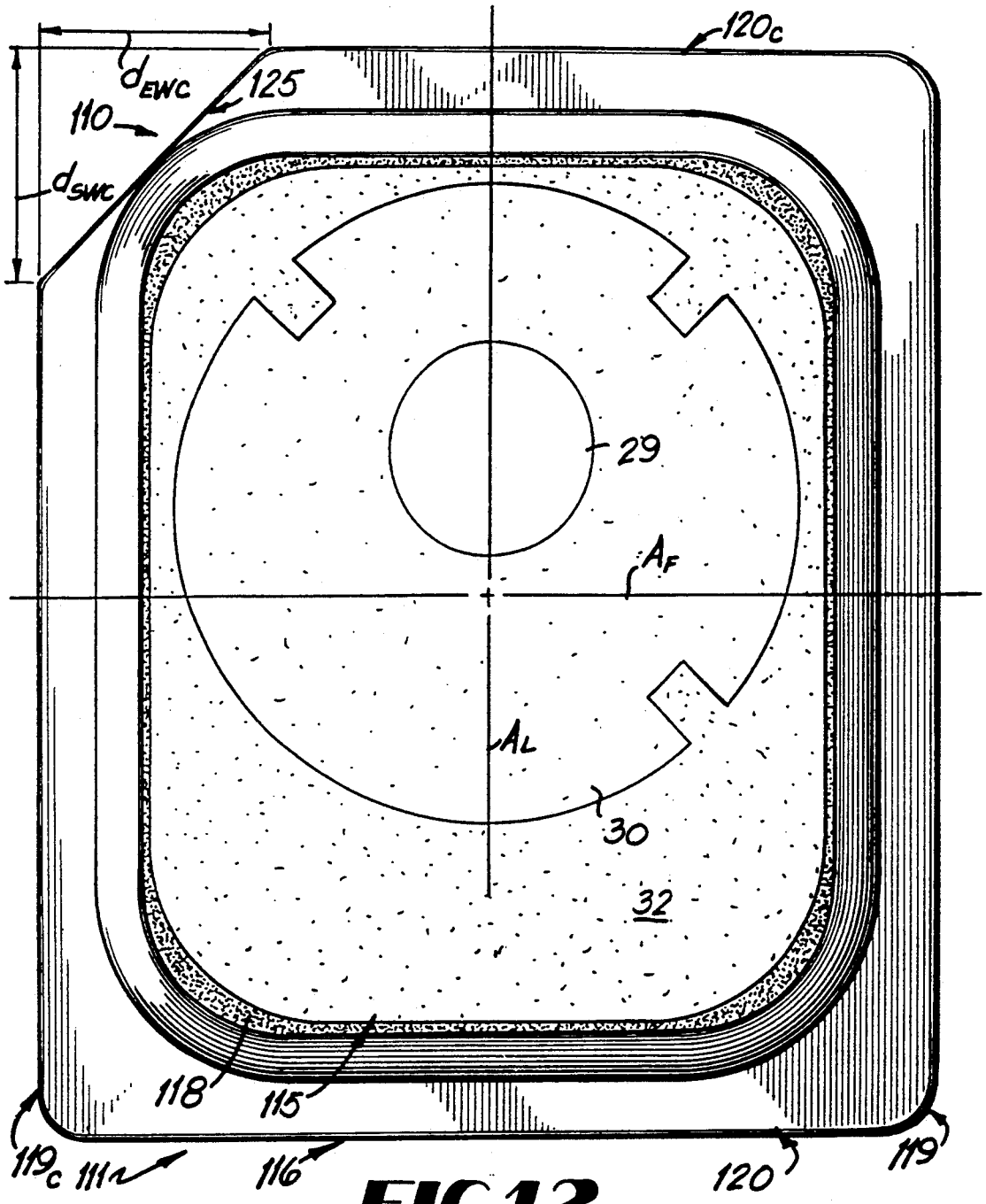
FIG. 12 is an enlarged bottom view of a running gate incorporating an alternate embodiment of the invention.
Figure 13:
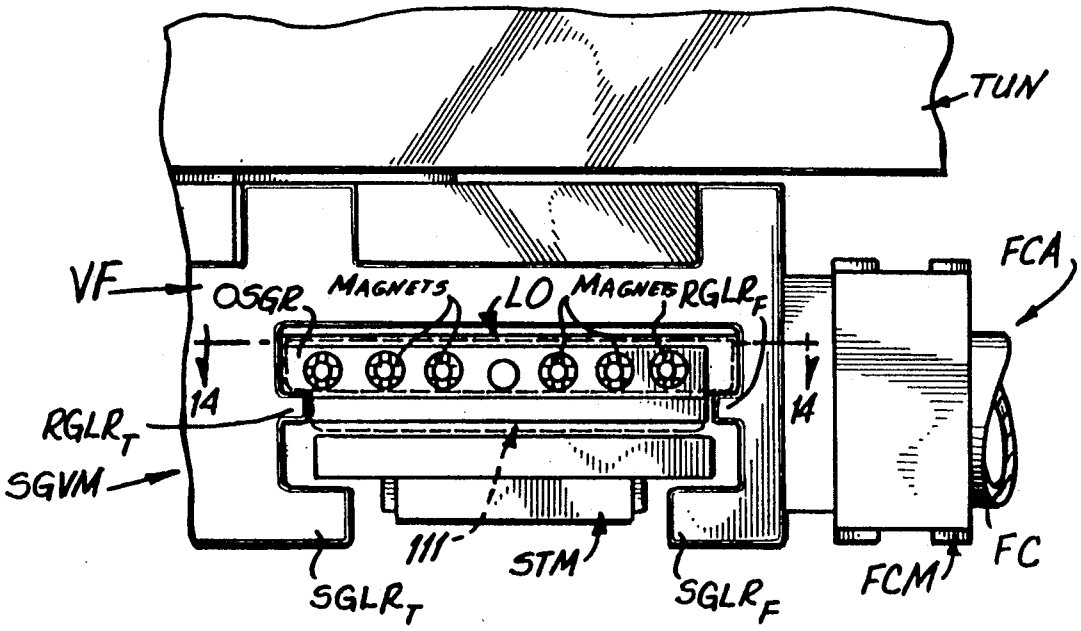
FIG. 13 is a view looking along the loading path into the valve mechanism with the alternate running gate of FIG. 12 being loaded into position.
Figure 15:
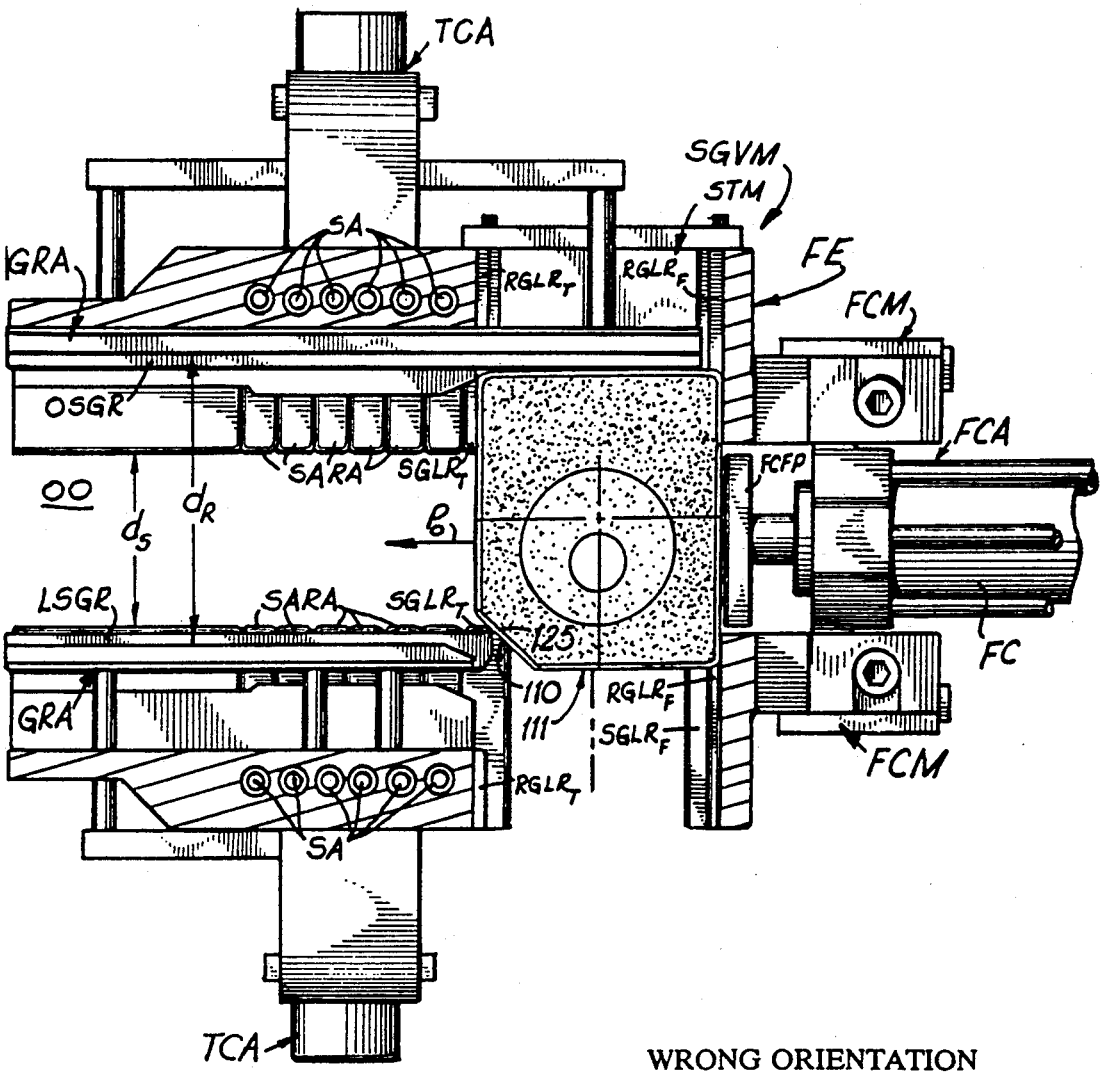
FIG. 15 is a view taken along line 14—14 in FIG. 13 showing the alternate running gate loaded with wrong orientation.
Figure 16:
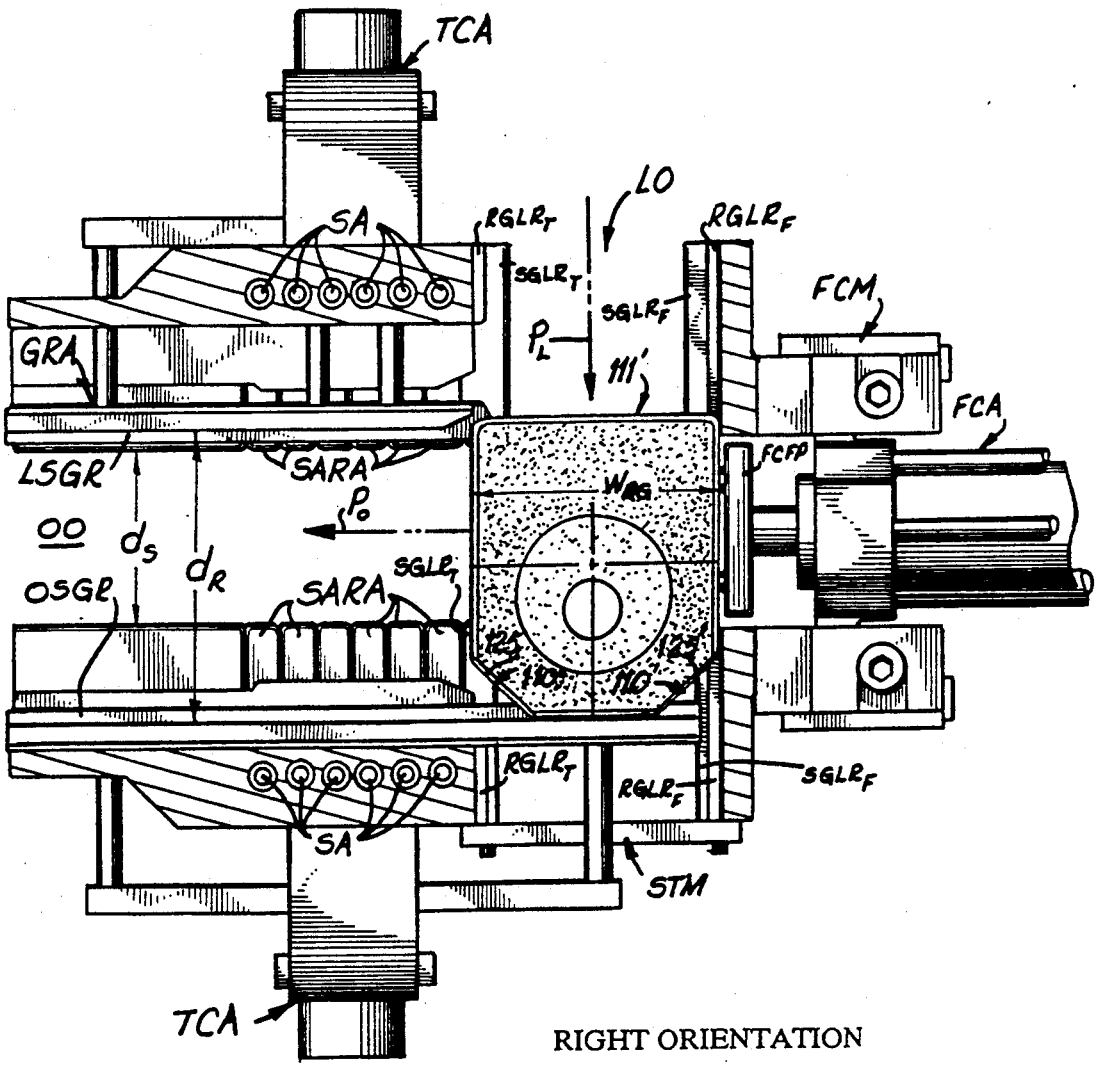
FIG. 16 is a view taken along line 14—14 in FIG. 13 showing another version of the alternate running gate loaded with correct orientation; and, FIG. 17 is a view taken along line 14—14 in FIG. 13 showing the second version of the alternate running gate loaded with wrong orientation.
Figure 17:
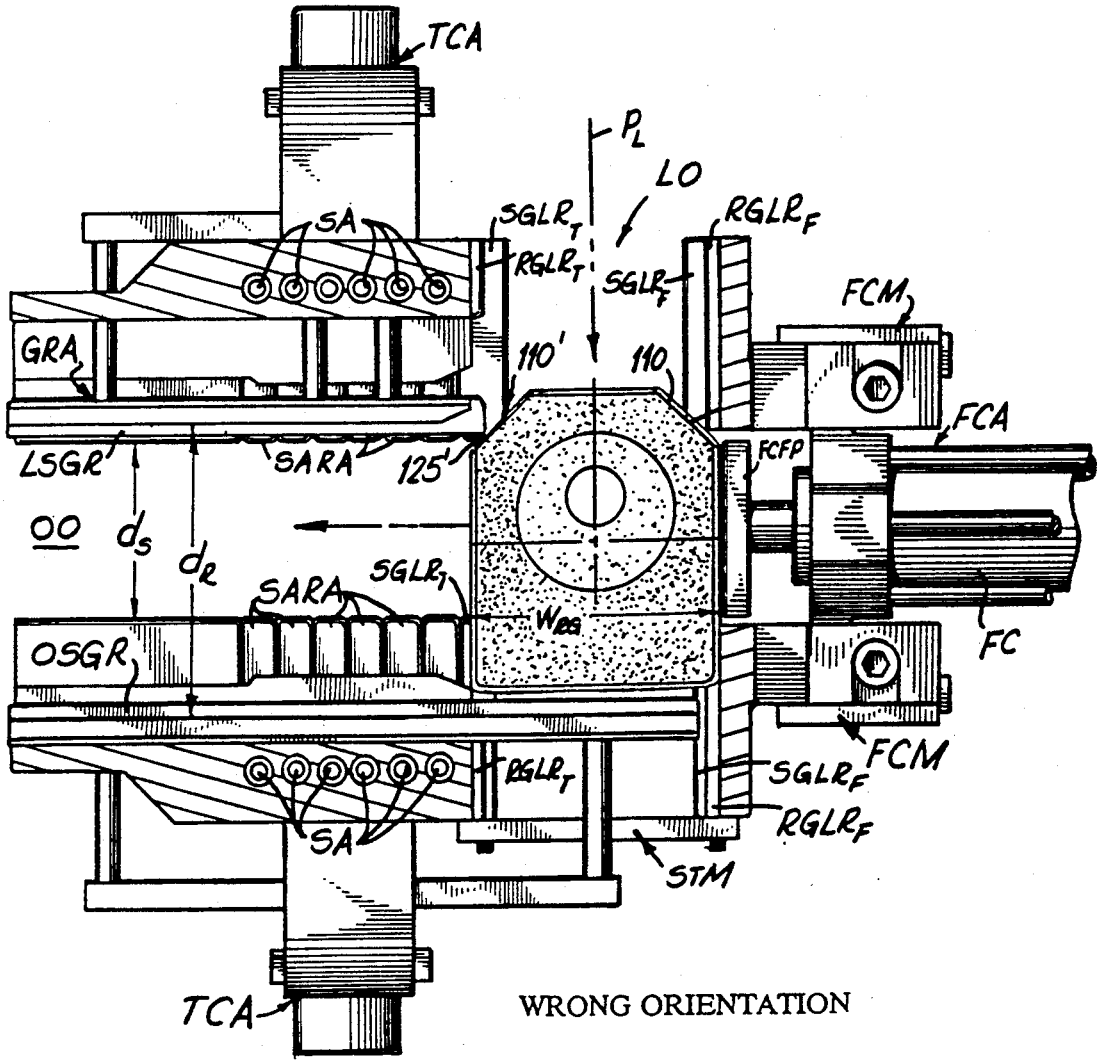

FIGS. 1–7 of the drawings illustrate a first embodiment 10 of the invention. FIG. 8 illustrates an alternate version 10′ of the first embodiment. FIGS. 9–11 illustrate the gate safety arrangement 10 used with a shroud gate assembly. FIGS. 12–15 illustrate a second embodiment 110 of the invention. FIGS. 16 and 17 illustrate an alternate version 110′ of the second embodiment.

Figure 1:
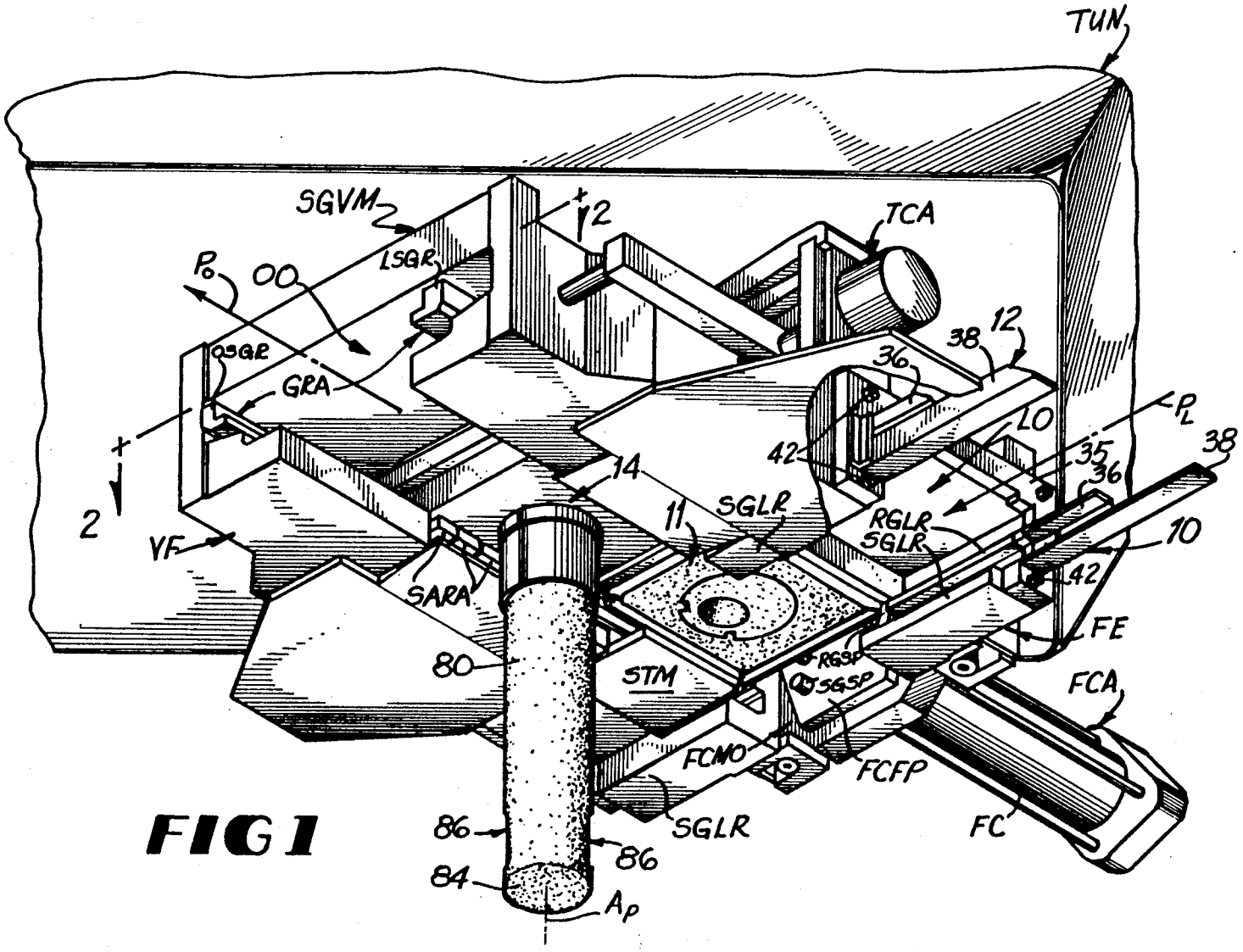
FIG. 1 is a perspective view of a valve mechanism with the invention installed.
Figure 2:
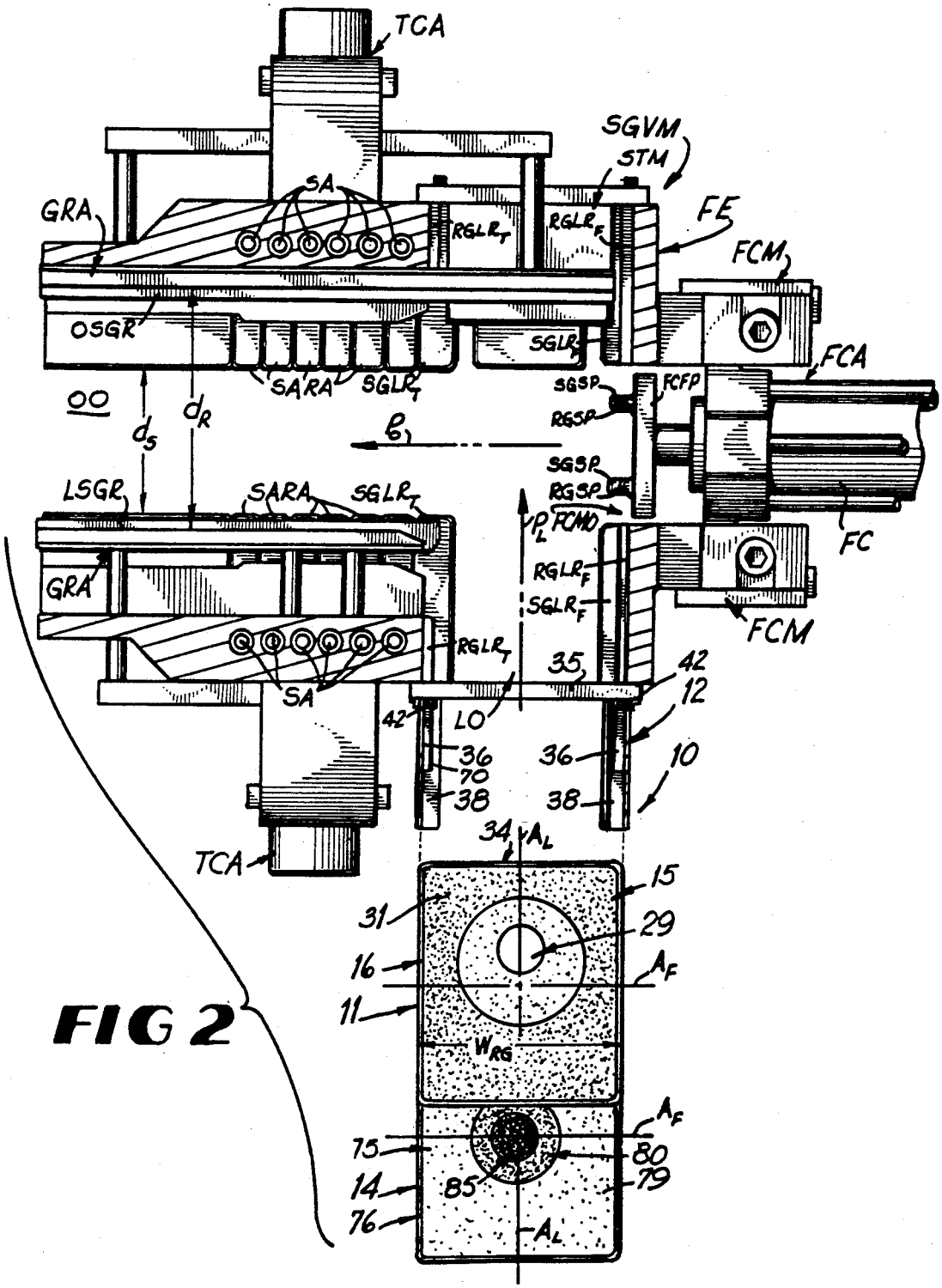
FIG. 2 is a cross-sectional view taken generally along line 2—2 in FIG. 1.

The valve mechanism SGVM with which the invention is illustrated is a sequential type valve gate mechanism such as that shown in U.S. Pat. No. 4,545,512, the disclosure of which is incorporated herein by reference. The valve mechanism is typically mounted on a tundish TUN as seen in FIG. 1. Basically, the valve mechanism SGVM as seen in FIGS. 1 and 2 includes a valve frame VF mounting a firing cylinder assembly FCA on one end and a pair of throttling cylinder assemblies TCA on opposite sides. The throttling cylinder assemblies TCA mount a guide rail assembly GRA within the frame VF to slidably support the running gates as will become apparent.

The main frame VF is generally horizontal during use and has an operating opening OO extending longitudinally through it along operating path $P_O$. A loading opening LO extends through frame VF along the loading path $P_L$ perpendicular to operating path $P_O$. Since the opening LO extends completely through the frame VF, the gates can be loaded from either side of the frame.

As best seen in FIG. 2, the frame VF has a pair of running gate loading rails RGLR that extend along opposite sides of the loading opening LO intermediate the height of the opening and a pair of shroud gate loading rails SGLR that extend along the loading opening below the running gate loading rails RGLR. The firing end FE of the valve frame VF is provided with a firing cylinder mounting FCM a central opening FCMO centered on the operating path $P_O$. The opening FCMO interrupts the firing side loading rail $RGLR_F$ for the running gate and the firing side loading rail $SGLR_F$ for the shroud gate. The operating opening OO interrupts the throttling side loading rail $RGLR_T$ for the running gate and the throttling side loading rail $SGLR_T$ for the shroud gate.

The firing plate FCFP on the firing cylinder FC has a pair of running gate support projections RGSP in alignment with the firing side loading rail $SGLR_F$ when the plate FCFP is retracted as seen in FIG. 2. The plate FCFP also has a pair of shroud gate support projections SGSP in alignment with the firing side loading rail $SGLR_F$ when the plate FCFP is retracted. The space formed by the operating opening OO between the two sections of the running gate loading rail $RGLR_F$ is centered on the operating path $P_O$ and has an opening distance $d_R$ as seen in FIG. 2 greater than the loading length of the running gate. The space formed by the operating opening OO between the two sections of the shroud gate loading rail $SGLR_F$ is centered on the operating path $P_O$ and has an opening distance $d_S$ less than the loading length of the shroud gate. The distance $d_S$ corresponds to the opening distance between the ends of the rocker arms SARA of the spring assemblies SA that hold the shroud gates and the running gates in place during operation.

Once that end of the loading opening LO to be used for the installation of the gates is selected, the opposite end of the opening LO is closed by a conventional stuffer member STM as seen in FIGS. 1 and 2. The stuffer member STM serves to arrest the movement of the shroud gate as it is loaded into the valve mechanism along the loading opening LO.

The guide rail assembly GRA as best seen in FIG. 2 includes a loading side guide rail LSGR which extends along that side of the operating opening OO nearest that portion of the loading opening LO being used to load the gates. The guide rail assembly GRA also includes an off side guide rail OSGR which extends along that side of the operating opening OO opposite the rail LSGR. The loading side guide rail LSGR extends from the edge of the loading opening LO to the discharge end of the frame VF so that the running gate being loaded can pass thereby as it moves into loaded position. The off side guide rail OSGR, on the other hand, extends across the loading opening LO and along the length of the operating opening OO to the discharge end of the frame VF.

The safety gate arrangement 10 best seen in FIGS. 3–7 includes a running gate 11 and a pre-positioning guide assembly 12 operatively associated with the gate 11 to permit the gate to be loaded into the valve mechanism SGVM only when the gate is properly oriented. The safety gate arrangement 10 may also be used to load the shroud gate assembly 14 as will become apparent.

The running gate 11 corresponds to the refractory slide plate in U.S. Pat. No. 4,545,512. The rectilinear gate 11 includes a running gate ceramic 15 mounted in a metal retainer 16 with mortar 18.

The metal retainer 16 has a loading central axis $A_L$ and a firing central axis $A_F$ normal to the loading central axis $A_L$. The retainer 16 has a pair of L-shaped side walls 19 parallel to the loading central axis $A_L$ joined by a pair of L-shaped end walls 20 parallel to the firing central axis $A_F$. Each of the side walls 19 and end walls 20 have an upstanding flange 21 joined to an inwardly directed bottom flange 22. The bottom flanges 22 join with a depending bottom lip 24 at their inner ends. The metal retainer 16 thus conventionally defines an upwardly opening ceramic receiving recess therein as is conventional.

Figure 5:
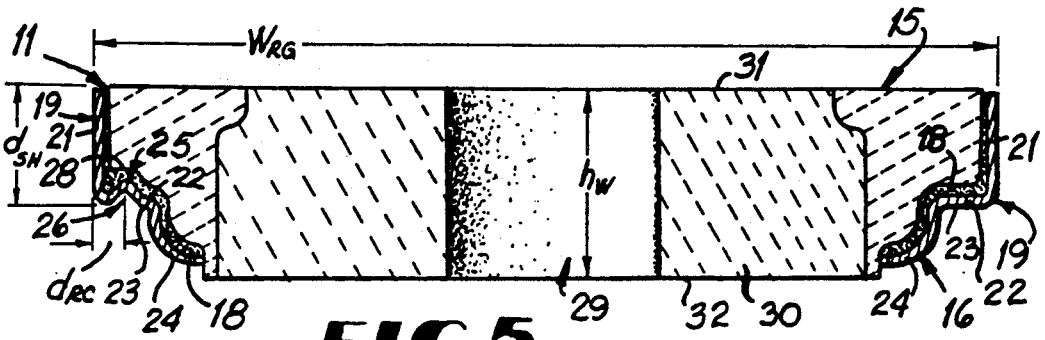
FIG. 5 is an enlarged cross-sectional view of the running gate taken along line 5—5 in FIG. 4.

One of the bottom flanges 22 of one of the side walls 19 has a recess section 25 formed therein defining a downwardly opening recess 26 along the length of the side wall 19. The recess 26 may have any convenient cross-sectional shape, however, an inverted V-shape or rounded shape is satisfactory. The recess 26 is parallel to the upstanding flange 21 and is spaced inwardly of the flange 21 a distance $d_{RC}$ to its central axis $A_{RC}$ as seen in FIG. 5.

The running gate ceramic 15 conforms generally to the ceramic receiving recess in the metal retainer 16 with a mortar space. A clearance recess 28 is provided along the bottom of the ceramic 15 to clear the recess section 25 in the retainer 16. The ceramic 15 defines a metal flow passage 29 therethrough which is offset from the firing central axis $A_F$ along the loading central axis $A_L$ as is typical for running gates. The passage 29 may be formed in a refractory insert 30 positioned in the ceramic 15. The difference between the ceramic 15 and the prior art is the recess 28. The ceramic 15 defines an upper sealing surface 31 thereon parallel to the plane defined by the axes $A_L$ and $A_F$ and a lower sealing surface 32 parallel to the surface 30. These surfaces form seals in the valve mechanism SGVM during metal pouring. The gate 11 has an overall working height $h_w$ defined by the sealing surfaces 31 and 32. A shoulder distance $d_{SH}$ is defined between the bottom surface 23 on the bottom flange 22 of side wall 19 and the upper sealing surface 31 as best seen in FIG. 5. The distance $d_{SH}$ is used as a gauge to control the orientation of gate 11 as will become more apparent.

The pre-positioning guide assembly 12 is mounted on the valve frame VF around the entrance to the loading opening LO as best seen in FIGS. 1 and 2 and cooperates with the recess 26 in the retainer 16 of the gate 11 to permit the loading of the running gate 11 only when it is properly oriented. The guide assembly 12 includes a base member 35 which is removably attached to the valve frame VF, a pair of running gate guide angles 36 mounted on the base member 35 in registration with the running gate loading rails RGLR on the frame VF, and a pair of shroud gate guide angles 38 mounted on the base member 35 in registration with the shroud gate loading rails SGLR on the frame VF.

Figure 3:
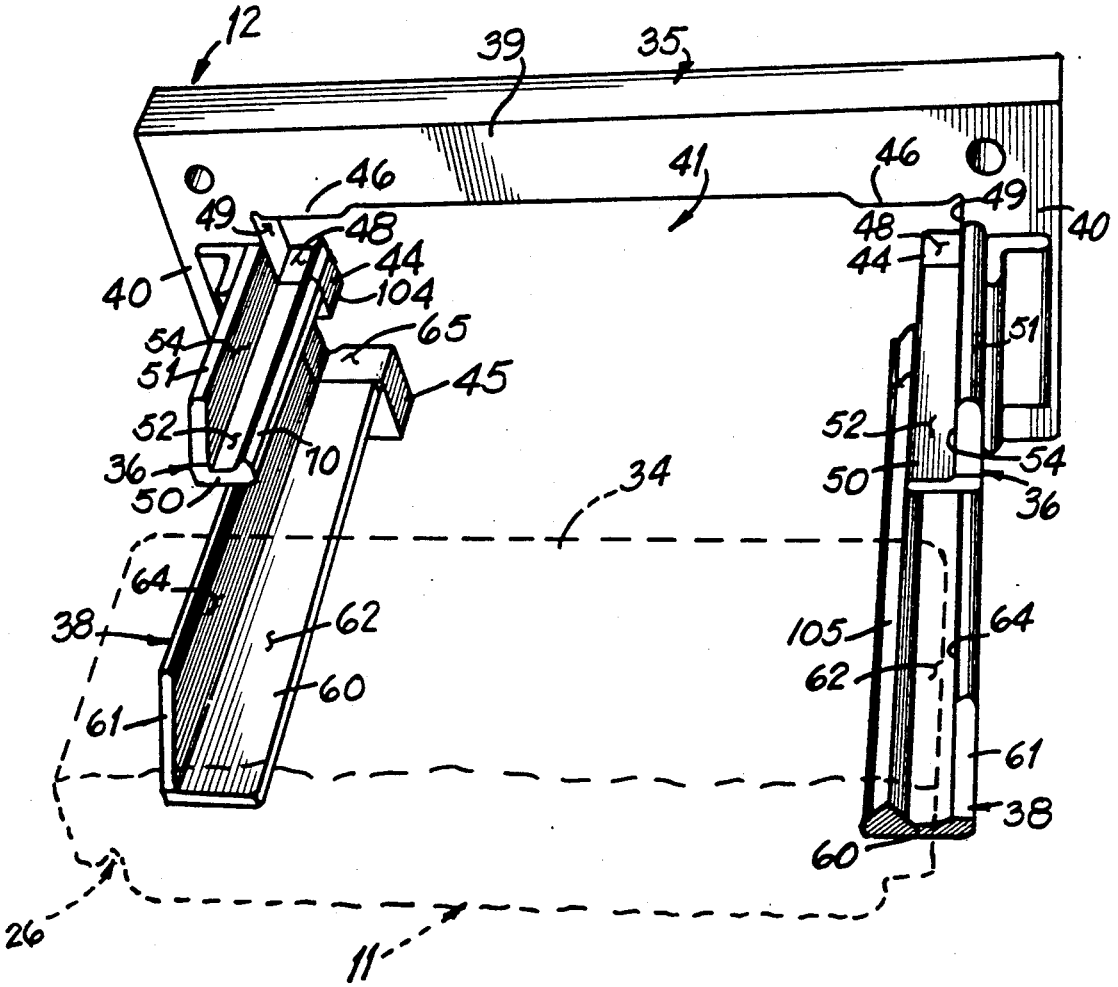
FIG. 3 is an enlarged perspective view of the invention.
Figure 4:
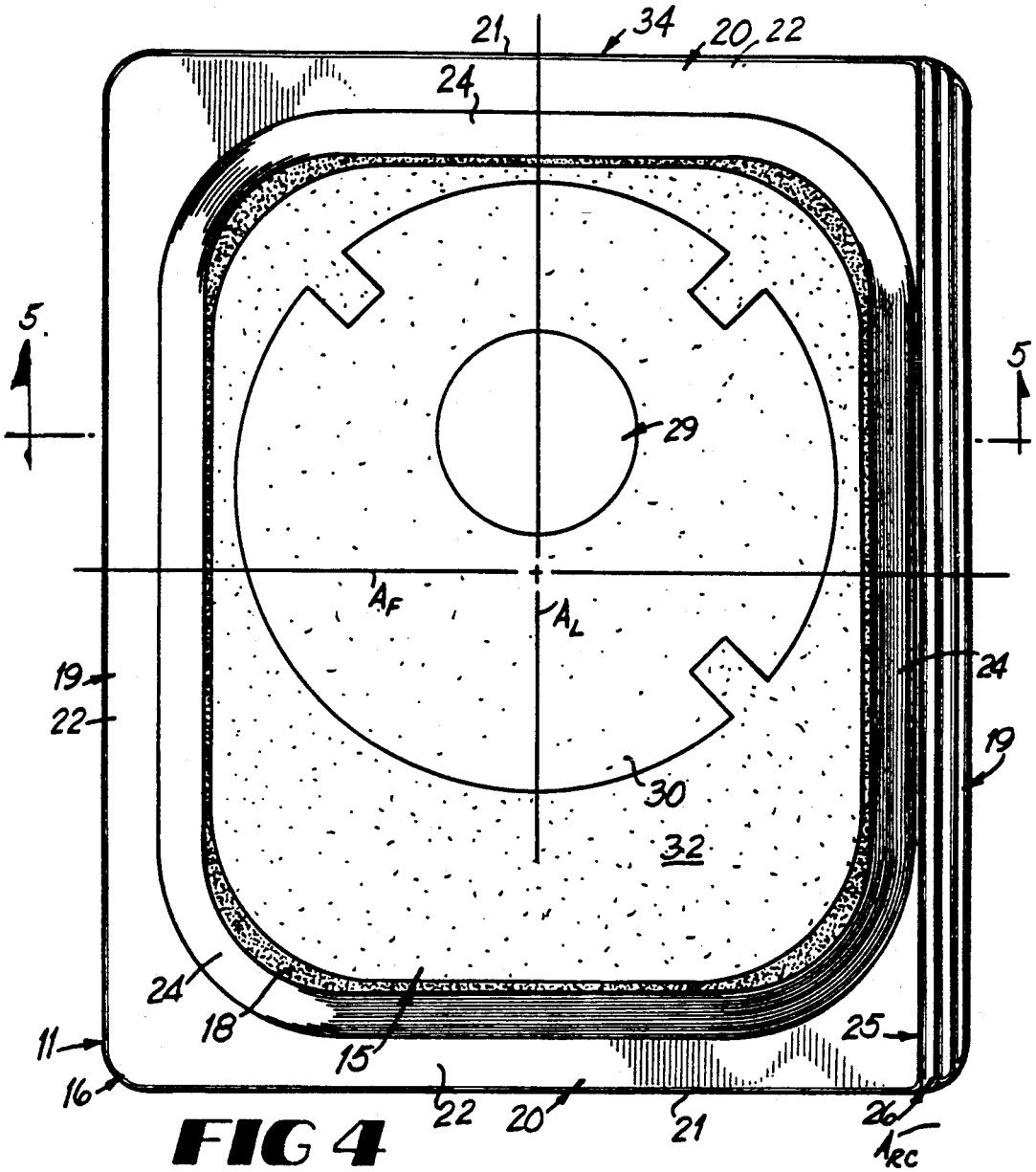
FIG. 4 is an enlarged bottom view of the running gate incorporating the invention.

The base member 35 best seen in FIGS. 3 and 6 has a general inverted U-shape with a top section 39 and a pair of depending legs 40 integral with opposite ends of the top section 39. The base member 35 defines a loading opening 41 therethrough corresponding to the cross-sectional shape of the loading opening LO in the frame VF. It is attached to the frame VF around the entrance of the opening LO with attachment bolts 42 as best seen in FIGS. 1 and 2.

As best seen in FIG. 3, each leg 40 includes a running gate loading tab 44 which projects into the loading opening 41 to support the running gate 11 while it is being checked for orientation. The two loading tabs 44 are horizontally aligned across the loading opening 41 and are axially aligned with the two running gate loading rails RGLR in the frame VF. The lower end of each of the legs 40 mounts a shroud gate loading flange 45 which projects into the loading opening 41 at a position spaced below the associated loading tab 44 so that the shroud gate will be supported. The two loading flanges 45 are also horizontally aligned across the loading opening 41 and are axially aligned with the two shroud gate loading rails SGLR in the frame VF.

The top section 39 defines a pair of depending gauging tabs 46 thereon facing the running gate loading tabs 44 and spaced thereabove a gauging distance $d_{RG}$. This distance is substantially equal to the running gate shoulder height $h_{SH}$ so that the running gate 11 will just clear the gauging tabs 46 when the bottom surfaces 23 of the retainer side walls 19 are resting flat on the upper surfaces 48 on the loading tabs 44. Thus, if the surfaces 23 are not lying flat on the tabs 44, the gate 11 will not pass through the loading opening 41 as will become more apparent. The inside edges 49 of legs 40 form the sides of the opening 41 and are spaced apart the distance $d_{SO}$ corresponding to the overall gate width $W_{RG}$.

As best seen in FIG. 6, each of the running gate guide angles 36 includes an inwardly directed bottom support flange 50 and an upstanding side guide flange 51 along the outside edge of the flange 50. The flanges 50 are parallel to each other and spaced apart an opening distance $d_{FO}$ at their inside edges. The distance $d_{FO}$ is selected so that the inside edges of flanges 50 just clear the depending bottom lips 24 on the gate 11 when the bottom surfaces 23 on gate 11 are supported on the upper support surfaces 52 on flanges 50 as seen in FIG. 7. The distance $d_{SO}$ between the inside surfaces 54 of side flanges 51 corresponds to the gate width $W_{RG}$ so that the flanges 51 laterally guide the gate 11 along the loading path $P_L$ with the loading axis $A_L$ of gate 11 in vertical registration with path $P_L$ as will become more apparent.

The angles 36 are arranged so that the support surfaces 52 are coplanar with the upper surfaces 48 on the loading tabs 44 on base member 35. In like manner, the inside surfaces 54 on flanges 51 are coplanar with the inside edges 49 on the base member 35.

Each of the shroud gate guide angles 38 includes an inwardly directed bottom support flange 60 and an upstanding side guide flange 61 along the outside edge of the flange 60. The flanges 60 are parallel to each other and support the gate assembly 14 on their upper support surfaces 62. The distance $d_{SGO}$ between the inside surfaces 64 of side flanges 61 corresponds to the width $W_{SG}$ of the shround gate assembly 14 so that the flanges 61 laterally guide the gate assembly 14 along the loading path $P_L$ with the loading axis $A_L$ of gate assembly 14 in vertical registration with path $P_L$ as will become more apparent.

The angles 60 are arranged so that the support surfaces 62 are coplanar with the upper surfaces 65 on the loading flanges 45 on base member 35. In like manner, the inside surfaces 64 on flanges 61 are coplanar with the inside edges 49 on the base member 35.

To insure that the running gate 11 can be loaded in only one orientation, a locating projection 70 is provided on one of the bottom support flange 50 of the angles 36 as seen in FIGS. 3, 6 and 7. The projection 70 is located on top of the support surface 52 and extends parallel to the loading path $P_L$. The locating projection 70 has a cross-sectional size and shape which are complementary to that of the recess 26 in gate 11 so that the bottom surface 23 on retainer 16 can lie against the upper surface 52 on angle 38 only when the projection 70 lies within the recess 26 in gate 11. The surface to center distance $d_{GP}$ between the inside surface 54 on the side flange 51 and the central axis $A_{GP}$ of projection 70 is the same as the side to center distance $d_{RC}$ on gate 11. Thus, the gate 11 will only lay flat on guide angle 38 when the gate 11 is in its one correct orientation. While this may be changed, the location for recess 26 and projection 70 shown is designed to orient the hole end 34 on gate 11 leading the gate into the frame VF as illustrated in FIG. 2. The gate 11 can be reversed simply by using a guide assembly 12 with the projection 70 on the opposite angle 38. While the projection 70 is illustrated as extending along the length of the flange 50 and across the upper surface 48 on the tab 44, the length thereof is not critical as long as it is located close enough to the gauging tab 46 to raise the gate 11 so that it will not pass under the tab 46 if the recess 26 is not in registration with the projection 70.

The recess/projection combination may be located at other positions on the gate 11 and on the pre-positioning guide assembly 12. FIG. 8 illustrates one alternate embodiment of the gate safety arrangement designated 10'. The recess 26' is located in the upstanding flange 21 on the sidewall 19 of metal retainer 16 rather than in the bottom flange 22. The running gate ceramic 15 has a recess 28' in the side edge thereof rather than in its bottom to clear the recess section 25'. Likewise, the projection 70' on the pre-positioning guide assembly 12 is located on the side guide flange 51 rather than on the bottom support flange 50. Otherwise the construction is the same.

The shroud gate assembly 14 corresponds generally to the refractory pour tube assembly in U.S. Pat. No. 4,545,512. The gate assembly 14 seen in the FIGS. 1, 4 and 9–11 includes a refractory component assembly 75 and a metal retainer assembly 76 held together by mortar 78. The refractory component assembly 75 basically acts to shroud the molten metal during pouring while the metal retainer assembly 76 protects the top of the refractory component assembly 75 as the shroud gate assembly 14 is being loaded into and removed from the valve mechanism SGVM. The shroud gate assembly 14 has a central axis $A_P$ which is generally vertically oriented when the assembly is in use as seen in FIG. 1. The shroud gate assembly 14 also has a firing axis $A_F$ normal to the central axis $A_P$ and a transverse loading axis $A_L$ normal to both the central axis and firing axis as will become apparent. The firing and loading axes $A_F$ and $A_L$ are generally horizontally oriented when the gate assembly 14 is in use.

The refractory component assembly 75 seen in FIG. 10 includes an upper plate 79 and a shroud tube 80. The upper plate 79 mounts the shroud tube 80 therethrough. The mortar 78 also bonds the shroud tube 80 and the upper plate 79 together.

The shroud tube 80 includes an elongate tubular side wall 81 about the centerline $A_P$ with an annular support flange 82 integral with its upper end oriented perpendicular to the side wall 81 as seen in FIG. 10. The flange 82 fits through the upper plate 79 and is held in place in plate 79 by the metal retainer assembly 76 and the mortar 78. The lower end of side wall 81 is closed by integral end wall 84 as seen in FIGS. 1 and 9. The side wall 81 and support flange 82 define a common pour passage 85 therethrough opening through the top of flange 82. Side discharge openings 86 through opposite sides of the side wall 81 at the end wall 84 direct the molten metal out of the lower end of passage 85 as seen in FIGS. 1 and 9.

The metal retainer 76 best seen in FIGS. 9 and 10 includes a plate retainer 90 which has a peripheral shape corresponding to the peripheral shape of the upper plate 79. The retainer 76 includes upstanding side flanges 91 and a bottom wall 92 integral with the bottom edges of the flanges 91. The side flanges 91 have a height such that side flanges 91 do not project above the upper plate 79 and the retainer will not interfere with the sealing of the upper surface 101 of the plate 79 in the valve mechanism.

The bottom wall 92 defines a central opening therethrough through which the shroud tube 80 projects. An annular support flange 94 is integral with the bottom wall 94 is integral with the bottom wall 92 around the central opening and projects therebelow.

A tube support sleeve 95 is mounted in the flange 94 of the plate retainer 90 and projects below the bottom wall 92 around the side wall 81 of the shroud tube 80 to support same. The support sleeve 95 has an inside diameter corresponding to the outside diameter of the shroud tube 80 so that the shroud tube 80 just passes through the sleeve 95. The inside diameter of the support flange 94 is such that the support flange 94 just fits over and is welded to the upper end of the sleeve 95. The sleeve 95 has a height such that the shroud tube 80 is supported during loading and unloading but does not extend into the vicinity of the high heat of the casting mold.

When it is necessary to orient the shroud gate assembly 14, the bottom wall 92 has a recess section 98 formed therein to define a downwardly opening recess 99 across the bottom wall parallel to the loading axis $A_L$. The recess 99, like the recess 26 in the running gate 11, may have any convenient cross-sectional shape with an inverted V-shape being shown. The recess 99 is parallel to one of the upstanding side flanges 91 and spaced inwardly of the flange 91 a distance $d_{SGR}$ to its central axis $A_{SRC}$ as seen in FIG. 10.

A recess 100 is provided along the bottom of the upper ceramic plate 79 to provide clearance for the recess section 98 in the retainer 76. The upper sealing surface 101 is parallel to the plane defined by the axes $A_L$ and $A_F$ and mates with the lower sealing surface 32 on the running gate 11 during use to form a seal. The plate portion of the gate assembly 14 has an overall working height $h_{SW}$ defined between the sealing surface 101 and the bottom surface 102 of the plate retainer 90.

To insure that the shroud gate assembly 14 can be loaded in only one orientation, a locating projection 105 is provided on one of the bottom support flanges 60 as seen in FIGS. 3, 6 and 11. The projection 105 is located on top of the support surface 62 and extends parallel to the loading path $P_L$. The locating projection 105 has a cross-sectional size and shape complementary to that of the recess 99 in shroud gate assembly 14 so that the bottom surface 102 on retainer 90 can lie against the upper surface 62 on angle 38 only when the projection 105 lies within the recess 99 in shroud gate assembly 14. The surface to center distance $d_{SGP}$ between the inside surface 64 on the side flange 61 and the central axis $A_{SGP}$ of projection 105 is the same as the side to center distance $d_{SGR}$ on shroud gate assembly 14 as best seen in FIG. 6. Thus, the shroud gate assembly 14 will only lay flat on guide angle 38 when the shroud gate assembly 14 has one orientation. The shroud gate assembly 14 can be reversed simply by using a guide assembly 12 with the projection 105 on the opposite angle 38. While the projection 105 is illustrated as extending along the length of the flange 60 and across the upper surface 62 on the flange 60, the length is not critical as long as it is located close enough to the bottom gauging surface 104 on tab 44 to raise the shroud gate assembly 14 so that it will not pass under the tab 44 if the recess 99 is not in registration with the projection 105.

FIGS. 12–15 illustrate a second embodiment of the invention designated as the safety gate arrangement 110 applied to a running gate 111. The safety gate arrangement 110 does not require a pre-positioning guide assembly as does the first embodiment, but rather, utilizes the construction of the gate 111 itself to prevent it from being loaded to the firing position in the valve mechanism SGVM.

The gate 111, like the gate 11, has a running gate ceramic 115 mounted in a metal retainer 116 with mortar 118, a loading axis $A_L$ and a firing axis $A_F$. The metal retainer 116 has L-shaped side walls 119 parallel to the axis $A_L$ and L-shaped end walls 120 parallel to the firing axis $A_F$ which hold the ceramic 115 similarly to that for the first embodiment.

The difference between this embodiment and a conventional running gate is that one of the corners of gate 111 is cut off to define a disabling cutout 125. The cutout 125 extends along the side wall 119 a distance $d_{SWC}$ and along the end wall 120 a distance $d_{EWC}$. If the gate 111 is loaded into the valve mechanism SGVM with the cutoff side wall $119_c$ facing away from the firing cylinder assembly FCA as seen in FIG. 15, end of the loading side guide rail LSGR facing the firing cylinder assembly FCA will stop supporting the gate 111 before the leading end of the gate 111 reaches the off side guide rail OSGR and allow the gate 111 to fall out of the mechanism SGVM. The cutout 125 may have any convenient shape and is illustrated as triangular only as an example.

Figure 14:
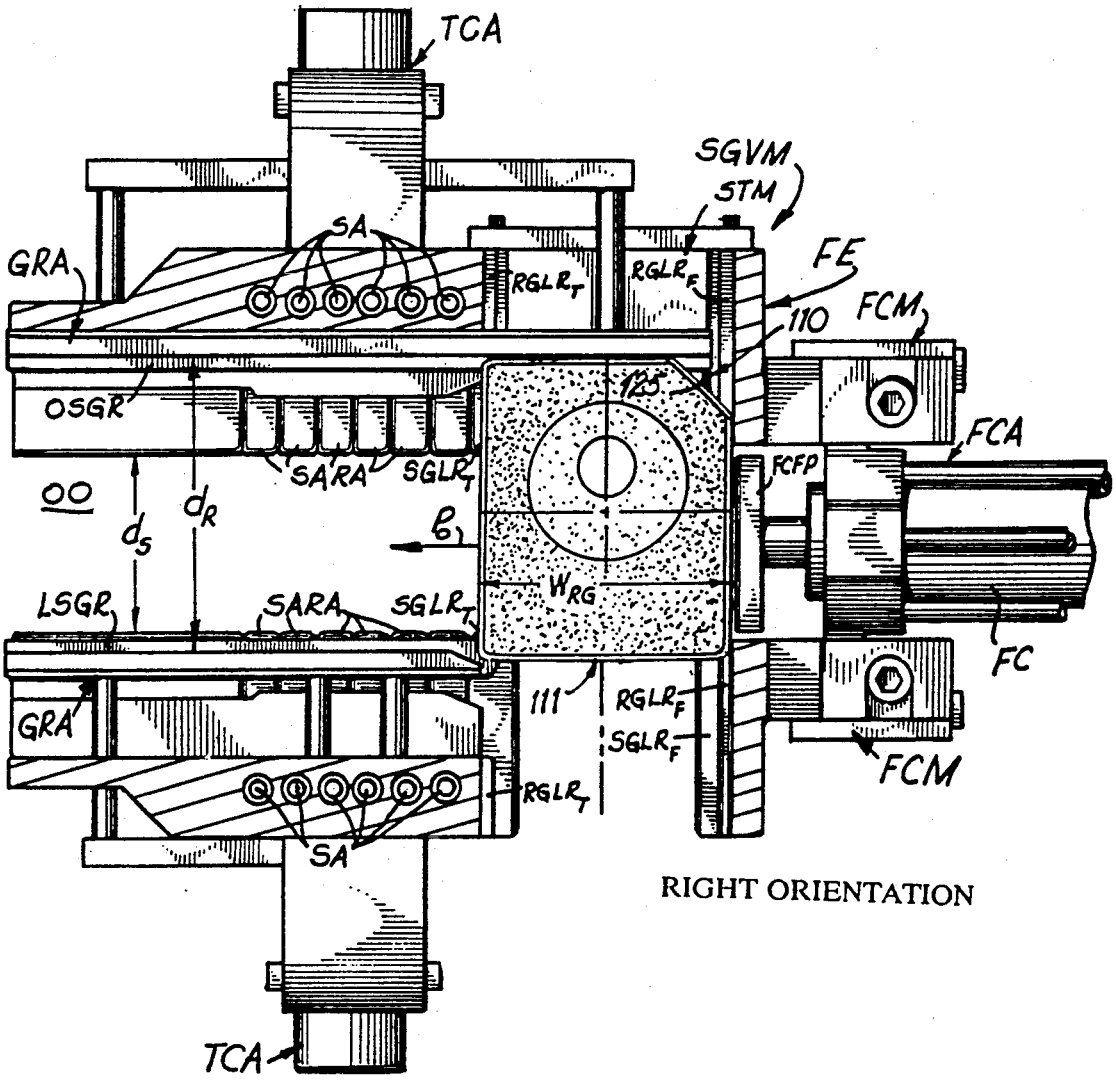
FIG. 14 is a view taken along line 14—14 in FIG. 13 showing the alternate running gate loaded with correct orientation.

When the gate 111 is loaded with the proper orientation, that is, with the cutout 125 leading as seen in FIG. 14, it will be seen that the projecting end of the loading side guide rail LSGR continues to support the gate 111 so that the gate can move to the loaded position as seen in FIG. 14. Except for the orientation, the gate 111 is loaded in the same manner as a conventional running gate.

In some instances, the running gates 111 are loaded from different sides of the valve mechanisms SGVM in plants where multiple valve mechanisms are used. To permit the gate to be loaded in any of these valve mechanisms a modified gate 111' as seen in FIGS. 16 and 17 is provided. The gate 111' has two cutouts 125 thereon, one on each of the corners that lead the gate into the mechanism when the gate is properly oriented. The gate 111' will not only fit in the valve mechanism seen in FIGS. 14 and 15, but also in a valve mechanism SGVM loaded from the opposite side as seen in FIGS. 16 and 17. Thus, when gate 111' is loaded in the valve mechanism SGVM seen in FIGS. 14 and 15, it functions like gate 111 using cut out 125. When gate 111' is loaded in the valve mechanism SGVM seen in FIGS. 16 and 17, it uses cut out 125' for orientation control.

What is claimed as invention is:

1. A gate for use in a valve mechanism equipped with side rails and a loading opening through which the gate is loaded into the mechanism along the side rails and through the loading opeining to a loaded position along a loading path, said gate comprising:

a) a metal retainer having a generally rectilinear shape, said retainer defining:
   a first central axis therethrough,
   a pair of opposed loading sides thereon generally parallel to said first central axis, and
   a leading end thereon; and, b) an asymmetrical guide surface associated with one of said loading sides of said retainer to engage the valve mechanism and cause said retainer to interfere with the valve mechanism about the loading opening as said gate is being moved along the slide rails toward the loaded position thus preventing said gate from being loaded into the loaded position along the loading path when said leading end of said retainer is trailing said gate as said gate is being loaded, and not engaging said valve mechanism so as to not interfere with the valve mechanism about the loading opening as said gate is being moved along the slide rails toward the loaded position thus permitting said gate to be loaded into the loaded position along the loading path when when said retainer has a prescribed orientation with respect to the loading path with said leading end leading as said gate is moved toward said loaded position in said valve mechanism.

2. The gate of claim 1 wherein said asymmetrical guide surface is a locating recess extending along the length of one of said loading sides parallel to the first central axis.

3. The gate of claim 2 wherein said retainer further defines a pair of first support surfaces thereon adapted to support said retainer in the valve mechanism, said first support surfaces extending along said loading sides of said retainer; and wherein said locating recess opens onto one of said first support surfaces.

4. The gate of claim 2 wherein said retainer further defines a pair of first guide edge surfaces thereon adapted to guide said retainer into the valve mechanism, said first guide edge surfaces parallel to said loading axis and extending along said loading sides of said retainer; and wherein said locating recess opens onto one of said first guide edge surfaces.

5. The gate of claim 2 further comprising:

a refractory member sized to fit in said metal retainer while defining a mortar space between said member and said retainer, said refractory member defining a clearance recess therein generally complementary to that portion of said metal retainer defining said locating recess therein while forming the mortar space therebetween, said refractory member defining an upper planar sealing surface thereon parallel to said loading axis; and, a refractory mortar filling said mortar space between said retainer and said refractory member and bonding said insert to said retainer.

6. The gate of claim 2 further comprising:

a refractory member bonded to said metal retainer, said refractory member defining a clearance recess therein complementary to that portion of said metal retainer defining said locating recess therein, said refractory member defining an upper planar sealing surface thereon parallel to said loading axis.

7. The gate of claim 6 wherein said refractory member further defines a lower planar sealing surface thereon parallel to said upper sealing surface.

8. The gate of claim 6 wherein said retainer further defines a pair of first support surfaces thereon adapted to support said retainer in the valve mechanism, said first support surfaces extending along said loading sides of said retainer and each of said support surfaces having outer and inner edges; and wherein said locating recess opens onto one of said first support surfaces between said outer and inner edges to form a locating edge on said support surface adjacent said outer edge.

9. The gate of claim 8 for use in the valve mechanism where said gate is moved from the loaded position into operative position in the mechanism along a firing path generally normal to the loading path, said retainer defining:

a firing central axis therethrough normal to said first central axis;

a pair of opposed operating sides thereon generally parallel to said firing central axis; and, a pair of operating support surfaces thereon adapted to support said retainer in the valve mechanism while said gate is in operative position, said operating support surfaces extending along said operating sides of said retainer.

10. A gate for use in a valve mechanism where the gate is loaded into the mechanism to a loaded position along a loading path, said gate comprising:

a) a metal retainer having a generally rectilinear shape, said retainer defining:

a first central axis therethrough, a pair of opposed loading sides thereon generally parallel to said first central axis, each of said loading sides having a leading end and a trailing end; and, a cutout on the leading end of one of said loading sides sized to cause said retainer to fall out of position in the valve mechanism as said gate is moved toward the loaded position if said gate is oriented so that the trailing ends of said loading sides lead said gate toward the loaded position.

11. The gate of claim 10 further including a cutout on the leading end of each of said loading sides sized to cause said retainer to fall out of position in the valve mechanism as said gate is moved toward the loaded position if said gate is oriented so that the trailing ends of said loading sides lead said gate toward the loaded position.

12. A gate safety system for a valve mechanism comprising:

a) a gate adapted to fit in and be loaded into said valve mechanism to a loaded position along a loading path, said gate having a generally rectilinear shape, defining a generally planar sealing surface thereon adapted to form a seal in said valve mechanism when said gate is in operative position in said valve mechanism, defining a leading end thereon, and defining a loading axis along said sealing surface to be oriented generally in registration with the loading path in the valve mechanism during the loading of said gate in the valve mechanism;

b) gate safety guide means on said gate; and, c) valve safety guide means on said valve mechanism and operatively associated with said gate safety guide means, said gate safety guide means and said valve safety guide means constructed and arranged to interfere with each other to prevent said gate from being loaded into said mechanism when said leading end thereon is trailing said gate as said gate is moved toward said loading position, but not interfere with each other when said loading axis on said gate is in registration with the loading path and said gate is oriented with said leading end leading as said gate is moved toward said loaded position in said valve mechanism.

13. The gate safety system of claim 12 wherein said gate comprises a metal retainer having a generally rectilinear shape, and defining a first central axis therethrough and a pair of opposed loading sides thereon generally parallel to said first central axis;

wherein said gate safety guide means includes an asymmetrical guide surface associated with one of said loading sides of said retainer; and, wherein said valve safety guide means includes a guide surface associated with said loading path and complementary to said asymmetrical guide surface to prevent said gate from being loaded into the loaded position along the loading path except when said asymmetrical guide surface on said retainer is seated on said complementary guide surface on said valve safety guide means.

14. The gate safety system of claim 13 wherein said asymmetrical guide surface is a locating recess extending along the length of one of said loading sides parallel to the first central axis;

wherein said guide surface on said valve safety guide means is an elongate locating projection having the same location and orientation with respect to the loading path as said locating recess is to said first central axis and a size and shape complementary to said locating recess so that said projection guides said gate along the loading path; and, wherein said safety guide means further defines a loading access opening therethrough through which said projection extends, said access opening sized and configured so that said gate will only pass therethrough when said locating projection is seated in said locating recess.

15. The gate safety system of claim 14 wherein said retainer further defines a pair of first support surfaces thereon adapted to support said retainer in the valve mechanism, said first support surfaces extending along said loading sides of said retainer; and wherein said locating recess opens onto one of said first support surfaces.

16. The gate safety system of claim 14 wherein said retainer further defines a pair of first guide edge surfaces thereon adapted to guide said retainer into the valve mechanism, said first guide edge surfaces parallel to said loading axis and extending along said loading sides of said retainer; and wherein said locating recess opens onto one of said first guide edge surfaces.

17. The gate safety system of claim 14 further comprising:

a refractory member sized to fit in said metal retainer while defining a mortar space between said member and said retainer, said refractory member defining a clearance recess therein generally complementary to that portion of said metal retainer defining said locating recess therein while forming the mortar space therebetween, said refractory member defining an upper planar sealing surface thereon parallel to said loading axis; and, a refractory mortar filling said mortar space between said retainer and said member and bonding said member to said retainer.

18. The gate safety system of claim 14 further comprising:

a refractory member bonded to said metal retainer, said refractory member defining a clearance recess therein complementary to that portion of said metal retainer defining said locating recess therein, said refractory member defining an upper planar sealing surface thereon parallel to said loading axis.

19. The gate safety system of claim 17 wherein said refractory member further defines a lower planar sealing surface thereon parallel to said upper sealing surface.

20. The gate safety system of claim 18 wherein said retainer further defines a pair of first support surfaces thereon adapted to support said retainer in the valve mechanism, said first support surfaces extending along said loading sides of said retainer and each of said support surfaces having outer and inner edges; and wherein said locating recess opens onto one of said first support surfaces between said outer and inner edges to form a locating edge on said support surface adjacent said outer edge.

21. The gate safety system of claim 20 for use in the valve mechanism where said gate is moved from the loaded position into operative position in the mechanism along a firing path generally normal to the loading path, said retainer defining:

a firing central axis therethrough normal to said first central axis;

a pair of opposed operating sides thereon generally parallel to said firing central axis; and, a pair of operating support surfaces thereon adapted to support said retainer in the valve mechanism while said gate is in operative position, said operating support surfaces extending along said operating sides of said retainer.

22. A gate safety system for a valve mechanism comprising:

a) a gate defining a loading axis thereacross adapted to fit in and be loaded into said valve mechanism to a loaded position along a loading path, defining a leading end thereon, and having an asymmetrical cross-sectional shape in a transverse plane normal to said loading axis; and b) a pre-position guide defining a loading axis and a gauging opening therethrough with said opening having a cross-sectional shape in a plane normal to said loading axis complementary to said asymmetrical cross-sectional shape for said gate so that said gate will only pass through said gauging opening when said asymmetrical cross-sectional shape of said gate is in registration with the asymetrical cross-sectional shape of said opening to require a single gate orientation with said leading end leading as said gate is moved toward said loaded position in said valve mechanism to pass through said gauging opening as said gate is loaded.

* * * * *